United States Patent [19]

Kulesza et al.

[11] Patent Number: 4,834,391

[45] Date of Patent: May 30, 1989

[54] TARGET GAME APPARATUS WITH STEPS

[75] Inventors: Ralph J. Kulesza, Chicago; Frank Wimmer, Arlington Heights; Jeffrey D. Breslow, Highland Park, all of Ill.

[73] Assignee: Marvin Glass & Associates, Chicago, Ill.

[21] Appl. No.: 149,721

[22] Filed: Jan. 29, 1988

[51] Int. Cl.[4] ..... A63F 7/02

[52] U.S. Cl. ..... 273/393

[58] Field of Search ..... 273/86 C, 86 D, 118 R, 273/120 R, 393

[56] References Cited

U.S. PATENT DOCUMENTS

| | | | |
|---|---|---|---|
| 3,033,570 | 5/1962 | Mathes et al. | 273/120 P X |
| 3,173,691 | 3/1965 | Kunneke | 273/120 R |
| 3,947,034 | 3/1976 | Waters | 273/123 R |
| 4,309,034 | 1/1982 | Matsumoto | 273/86 D |

*Primary Examiner*—Anton O. Oechsle

*Attorney, Agent, or Firm*—John S. Pacocha

[57] ABSTRACT

A game including a housing formed of two opposed halves that pivot together. Each half has steps from a raised end proximal a player to a gap at the lower distal end where the halves are pivotally connected. Two players are each allocated a number of marbles, that are initially placed adjacent the player's raised end, plus a larger shooter. By dropping the shooter, the player attempts to knock the marbles down the steps toward the gap. Whenever a player causes a marble to drop through the gap, the player gets another turn. After each turn, the player's shoot is returned to the player via a ramp. All of the marbles knocked down the steps and through the gap, drop through the shooter return ramp and are directed by another ramp toward the opposing player. Clearing the steps of all of the marbles allocated to a player wins the game.

18 Claims, 1 Drawing Sheet

TARGET GAME APPARATUS WITH STEPS

BACKGROUND OF THE INVENTION

1. Field of the Invention

This invention relates generally to games and more particularly to target games.

2. Background Art

Target games, including those utilizing marbles or balls, have long been popular pastimes. Marble shooting games, such as one in which a number of target marbles are placed generally in the center of a circle and players take turns propelling a shooter marble to hit the target marbles and possibly knock them out of the circle, are old in the art. More recent target games utilizing marbles or balls include pinball type games such as the one disclosed in Warrix U.S. Pat. No. 4,273,341, issued June 16, 1981 and marble target shooting games such as that disclosed in Wildman et al., U.S. Pat. No. 4,213,612, issued July 22, 1980. Nevertheless, there remains a need for target games utilizing balls or marbles that require a relatively simple apparatus for play and storage of the game.

SUMMARY OF THE INVENTION

The present invention is concerned with providing a game in which the housing includes a set of steps declining from a raised end proximal the player down to a gap at the lower distal end. In one form, the housing includes two such opposed sets of such steps. Marbles are placed along the uppermost step and a larger diameter shooter is dropped by the player in an attempt to knock the marbles down and off the steps at the lower distal end. Adjacent the lower distal end is one ramp that is inclined to one side to return the shooter to the player. Another ramp, disposed adjacent the lower distal end and below the shooter returning ramp, receives the marbles through a slot in the shooter returning ramp and directs the marbles knocked down the steps away from the player. Clearing the steps of all the marbles wins the game.

BRIEF DESCRIPTION OF THE DRAWINGS

For a better understanding of the present invention, reference may be had to the accompanying drawings in which.

DETAILED DESCRIPTION OF THE PREFERRED EMBODIMENT

Figures 1, 2, 3, 4, 5:
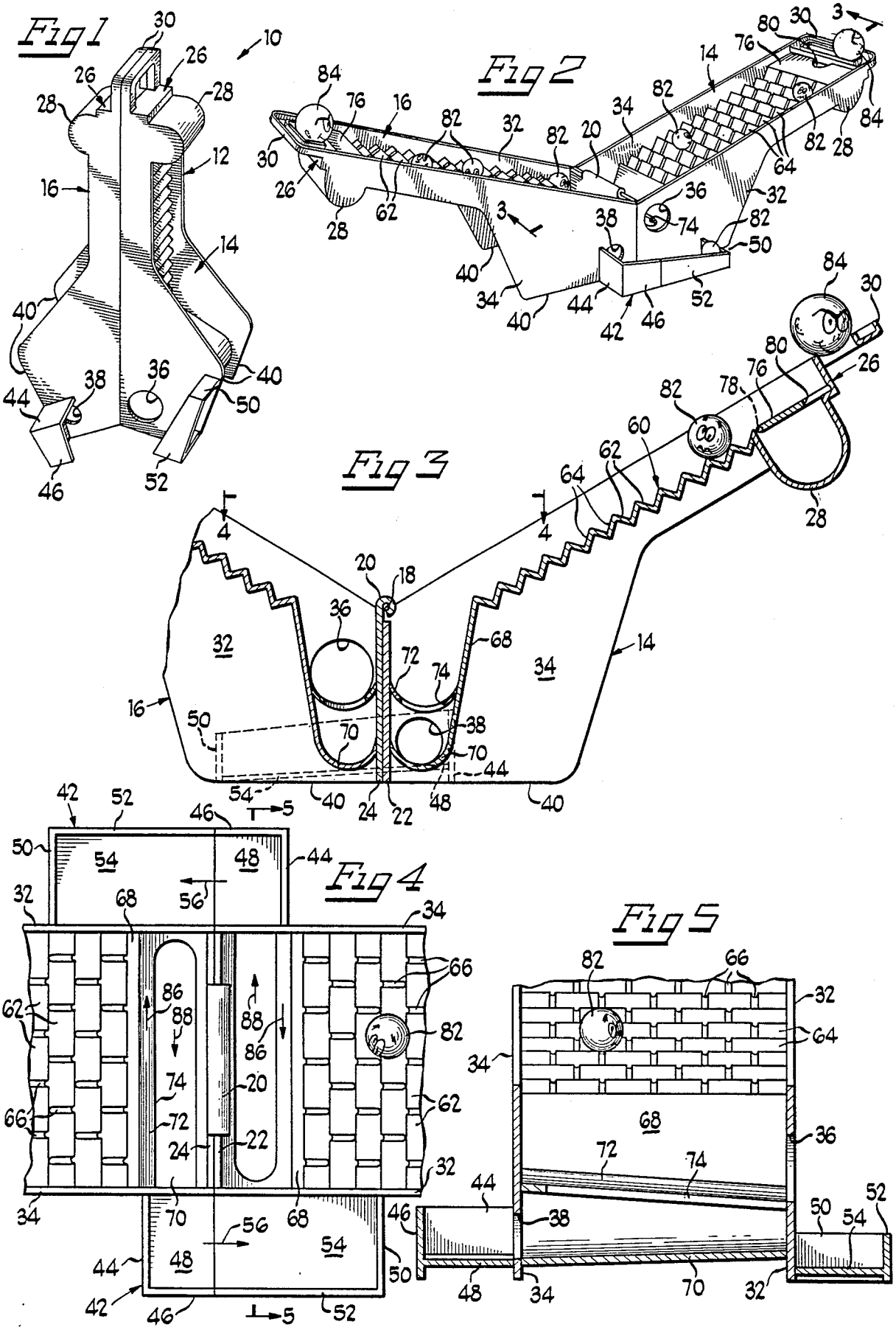
FIG. 1 is a perspective view of an embodiment of the present invention closed for storage.
FIG. 2 is a perspective view open for play.
FIG. 3 is an enlarged scale, fragmentary sectional view taken generally along line 3—3 of FIG. 2.
FIG. 4 is a fragmentary sectional view taken generally along line 4—4 of FIG. 3.
FIG. 5 is a fragmentary sectional view taken generally along line 5—5 of FIG. 4.

Referring now to the drawings in which like parts are designated by like reference numerals throughout the several views, FIG. 1 shows a game 10 including a housing 12 formed of two parts or halves 14 and 16. The two halves are pivotally connected to each other by a hinge pin 18 carried by half 14 and a hinge leaf 20 carried by half 16. Hinge pin 18 is generally in the plane of a player distal end wall 22 of half 14 while hinge leaf 20 is an integral extension of player distal end wall 24 of half 16.

Except for hinge pin 18 and leaf 20, halves 14 and 16 are substantially mirror images. When the two halves are in the open position, as illustrated in FIGS. 2, 3 and 4, end walls 22 and 24 abut each other. Opposite the hingedly connected ends, each half has a player proximal end wall 26. As is best illustrated in FIGS. 1 and 3, an extension of end wall 26 forms a U-shaped trough 28. Extending outwardly from each end wall 26 is a handle half 30.

Extending between end walls 22 and 26 of half 14 are spaced apart sidewalls 32 and 34. A relatively large diameter circular opening 36 extends through sidewall 32 As is best illustrated in FIGS. 1 and 3, an extension of end wall 26 forms a U-shaped trough 28. Extending outwardly from each end wall 26 is a handle half 30.

Extending between end walls 22 and 26 of half 14 are spaced apart sidewalls 32 and 34. A relatively large diameter circular opening 36 extends through sidewall 32 adjacent end wall 22 proximal the hinged connection with half 16. There is a relatively smaller diameter circular opening 38 through sidewall 34, adjacent end wall 22 but distal the hinged connection with half 16. Accordingly, when the halves are in the open for play position shown in FIGS. 2, 3 and 4, opening 36 is higher than opening 38 in the opposite side. On half 16, sidewalls 32 and 34 are reversed. Each of the four sidewalls has an edge 40 that lies in substantially the same plane when the two halves are in the open position with end walls 22 and 24 abutting. Game 10 is thus supported in the open for play position upon a generally planar playing surface such as a table top or floor.

On the outer side of each sidewall is a portion of an angled tray 42. Adjacent each of the smaller diameter openings 38, spaced from end walls 22 and 24, respectively, is a tray high end wall 44 that is substantially transverse to the respective sidewall 34. Substantially transverse to tray high end wall 44 is tray high sidewall 46 extending substantially parallel to sidewall 34 toward end wall 22 or 24, respectively. A tray high bottom wall 48 is adjacent edge 40, substantially transverse to sidewall 34. High bottom wall 48 is spaced a greater distance from edge 40 adjacent end wall 44 than it is spaced from edge 40 adjacent end wall 22 or 24.

The lower part of each tray 42 is formed of a tray low end wall 50 that is substantially transverse to sidewall 32, a tray low sidewall 52 that is substantially parallel to sidewall 32 and a tray low bottom wall 54 that extends out transversely from sidewall 32. Low bottom wall 54 is spaced a greater distance from edge 40 adjacent end walls 22 or 24 and generally meets edge 40 adjacent tray low end wall 50. Bottom walls 48 and 54 are at the same angle relative to the edges 40. When halves 14 and 16 are open to the playing position illustrated in FIGS. 2, 3 and 4, tray high bottom wall 48 and tray low bottom wall 54 lie in substantially the same plane at an angle to the plane formed by edges 40. As illustrated by arrows 56 in FIG. 4, each of the trays 42, or more particularly their combined bottom walls 48 and 54, angle downwardly from adjacent one of the lower, smaller diameter circular openings 38 in a direction toward the player end 26 of the other half.

Spanning between each set of sidewalls 32 and 34 are steps 60 that begin at the U-shaped trough 28 and lead down toward a respective one of the end walls 22 or 24. With the halves in the open for play position, steps 60 are disposed so that each tread 62 is at a downward and rearward angle toward player end 26. Each riser 64 is substantially transverse to the adjacent tread 62. A set of grooves 66 divides each tread and riser into a number of sections. The grooves in each tread are aligned with the grooves in the riser above it but staggered from the grooves in the riser below it.

At the bottom end of steps 60, opposite trough 28, there is gap between the bottommost step and the respective wall 22 or 24. From the bottommost step, a partition 68 drops down to form a curved ramp 70 that fits across the gap. As is best shown in FIG. 5, the curved ramp 70 angles downwardly from sidewall 32 toward sidewall 34 where it abuts sidewall 34 approximately tangent with the lowermost edge of the smaller diameter circular opening 38. Another ramp 72 is disposed above ramp 70 and is angled in the opposite direction, down toward the larger diameter opening 36. In the lowermost part of curved ramp 72 is a slot 74, the width of which is generally the same as the diameter of opening 38.

Over the open part of U-shaped trough 28 is a cover 76 that is mounted for pivotal movement about integrally formed pins 78 that extend out either side of the cover and are journaled in a respective sidewall. Cover 76 is also provided with a finger cutout 80. Game 10 includes a number of smaller diameter balls or marbles 82 and two larger diameter shooters 84. Each set of marbles and a shooter fits into a covered trough on each side.

The diameter of each marble 82 is such that the marbles easily fit through slot 74, in upper angled ramp 72, and through openings 38. Each player is conveniently provided with four such marbles. In addition, each player is provided with a larger diameter spherical shooter or projectile 84 that will not pass through slot 74 and hence will be conveyed by ramp 72 in the direction of arrows 86 in FIG. 4 to larger diameter opening 36 through which shooter 84 will pass. After marbles 82 drop through slot 74 they are conveyed by ramp 70, in the direction of arrows 88 in FIG. 4, out through opening 38 into the high end of tray 42 in which they roll toward the opposing player. Shooter or projectile 84 on the other hand, drops into the tray on the opposite side that is angled down toward the player to whom the shooter belongs.

In play, all of the marbles allocated to a player are initially lined up on the uppermost step. Each marble tends to sit in one of the grooves in the tread thus prohibiting the marbles from bunching up on the side of a step toward which the game may be tilted if it is not on a level surface. The players take turns dropping their respective shooters down the steps attempting to knock the marbles down the steps and into the gap between the lowermost step and respective wall 22 or 24. Whenever a player knocks a marble off of the steps and into the gap, the player gets another turn. As is illustrated in FIGS. 2 and 3, shooter 84 may conveniently be rested in the opening formed between handle 30 and end wall 26. Clearing the steps of all of the marbles allocated to a player wins the game.

During play, cover 76 is kept in the closed position shown in FIGS. 2 and 3. However, when play is over, cover 76 is pivoted upwardly to open trough 28 for storage of shooter 84 and marbles 82. Halves 14 and 16 are then folded toward each other about the axis of hinge pin 18 to the closed storage position illustrated in FIG. 1.

While a particular embodiment of the present invention has been shown and described, changes and modifications will occur to those skilled in the art. It is intended in the appended claims to cover all such changes and modifications that fall within the true spirit and scope of the present invention.

What is claimed as new and desired to be secured by Letters Patent is:

1. A game comprising in combination:
a housing including spaced apart sides;
a high end to be positioned adjacent a player;
a low end to be positioned away from the player;
steps spanning between the spaced apart sides;
the steps going downwardly from the high end to the low end;
a plurality of target objects adapted to rest on the steps and to be dislodged from the steps;
a projectile adapted to be dropped onto the target objects resting on the steps in an attempt to dislodge the target object from the steps; and
means adjacent the low end for directing the target objects toward one side and the projectile toward the other side.

2. The game of claim 1 in which the target objects and the projectile are spherical with the diameter of the target objects being significantly less than the diameter of the shooter.

3. The game of claim 2 in which the means comprises:
a lower ramp angled toward the one side;
an upper slotted ramp angled toward the other side; and
the slot in the upper ramp permits the passage of the target objects down to the lower ramp.

4. The game of claim 3 including:
a pair of opposed halves;
each of the halves having the spaced apart sides, steps, high end, low end and means of claim 1;
the halves being connected together adjacent their respective low ends;
the one side of each half being opposite the one side of the other half;
the other side of each half being opposite the other side of the other half; and
and additional projectile.

5. The game of claim 4 in which the halves are pivotally connected together.

6. The game of claim 4 including additional means for directing each projectile from the respective other side back toward a respective player and further means for directing the target objects from the respective one side away from the respective player.

7. The game of claim 2 including:
a number of grooves extending across each step between the spaced apart sides;
the width and depth of each groove being sufficient to cause one of the target objects to come to rest when the target object is moving along the step from one side to the other side.

8. The game of claim 1 in which the means comprises:
a lower ramp angled toward the one side;
an upper slotted ramp angled toward the other side; and
the slot in the upper ramp permits the passage of the target objects down to the lower ramp.

9. The game of claim 8 including:
a pair of opposed halves;
each of the halves having the spaced apart sides, steps, high end, low end and means of claim 1;

the halves being connected together adjacent their respective low ends;

the one side of each half being opposite the one side of the other half;

the other side of each half being opposite the other side of the other half;

an additional projectile.

10. The game of claim 9 in which the halves are pivotally connected together.

11. The game of claim 9 including additional means for directing each projectile from the respective other side back toward a respective player and further means for directing the target objects from the respective one side away from the respective player.

12. The game of claim 11 in which: each half carries a part of the additional means; and each half carries a part of the further means.

13. The game of claim 1 including:

a pair of opposed halves;

each of the halves having the spaced apart sides, steps, high end, low end and means of claim 1;

the halves being connected together adjacent their respective low ends;

the one side of each half being opposite the one side of the other half;

the other side of each half being opposite the other side of the other half; and an additional projectile.

14. The game of claim 13 in which the halves are pivotally connected together.

15. The game of claim 13 including additional means for directing each projectile from the respective other side back toward a respective player and further means for directing the target objects from the respective one side away from the respective player.

16. The game of claim 11 in which:

each half carries a part of the additional means; and each half carries a part of the further means.

17. The game of claim 1 including additional means for directing the projectile back toward the player and further means for directing the target objects away from the player.

18. The game of including means for storage of the target objects and projectile.

* * * * *